US005291633A

United States Patent [19]

Morgan

[11] Patent Number: 5,291,633

[45] Date of Patent: Mar. 8, 1994

[54] COUPLING DEVICE

[75] Inventor: David Morgan, Fassaroe House, Ireland

[73] Assignee: Trumark Limited, Dublin, Ireland

[21] Appl. No.: 918,084

[22] Filed: Jul. 24, 1992

[51] Int. Cl.[5] ..... E05D 1/00

[52] U.S. Cl. ..... 16/225; 16/257; 16/366

[58] Field of Search ..... 16/221, 224, 225, 227, 16/257, 366

[56] References Cited

U.S. PATENT DOCUMENTS

| | | | |
|---|---|---|---|
| 3,995,742 | 12/1976 | Austin et al. | 16/225 |
| 4,506,408 | 3/1985 | Brown | 16/225 |
| 4,670,938 | 6/1987 | Fowlston | 16/225 |
| 4,731,903 | 3/1988 | Kennedy et al. | 16/224 |
| 4,777,777 | 10/1988 | Massimo | 16/225 |
| 4,974,289 | 12/1990 | Piard | 16/336 |

FOREIGN PATENT DOCUMENTS

| | | |
|---|---|---|
| 958497 | 5/1965 | United Kingdom . |
| 1146572 | 3/1969 | United Kingdom . |
| 2159573A | 12/1985 | United Kingdom . |

*Primary Examiner*—W. Donald Bray
*Attorney, Agent, or Firm*—Nikaido, Marmelstein, Murray & Oram

[57] ABSTRACT

A coupling device comprises a generally u-shaped member with a base 11 and two arms 12, 13, and retaining means at each arm for accommodating and retaining a respective cylindrical pin 30. One of the retaining means comprises an integral hook 14 extending from the inside of the arm 12 towards the other arm 11 and has a tip 15 which projects towards the base 11. The hook is sufficiently resilient to permit the tip 15 to be manually deflected away from the base 11 to permit a pin 30 of greater diameter than the distance between the tip and the base in the undeflected state of the hook to be inserted under the hook. The pin is retained between the hook and the base by releasing the hook and permitting it to assume its undeflected state.

8 Claims, 2 Drawing Sheets

COUPLING DEVICE

This invention relates to a coupling device. In particular, it relates to a coupling device which can also function as a hinge.

The invention, therefore, provides a coupling device comprising a generally u-shaped member having a base and two-arms, and retaining means at or adjacent each arm for accommodating and retaining a respective cylindrical pin rotatable about its own axis, at least one of the retaining means comprising an integral hook extending from the inside of the respective arm towards the other arm and having a tip which projects towards the base, the hook being sufficiently resilient to permit the tip to be manually deflected away from the base to permit a pin of greater diameter than the distance between the tip and the base in the undeflected state of the hook to be inserted under the hook, the pin being retained between the hook and the base by releasing the hook and permitting it to assume its undeflected state.

The invention will be understood in greater detail from the following description of a preferred embodiment thereof given by way of example only and with reference to the accompanying drawings in which.

Figure 1:
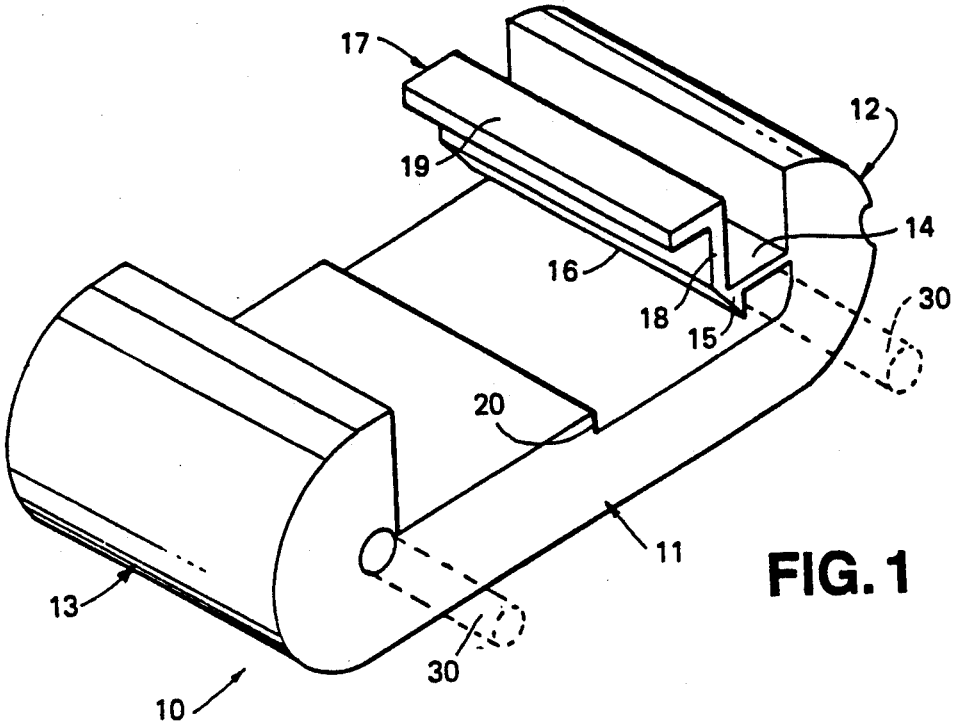
FIG. 1 is a perspective view of a coupling device according to the invention.

Referring now to the drawings, there is shown a coupling device 10 according to the invention which in cross-section comprises a shallow generally u-shaped member having a base 11, a first arm 12 and a second arm 13. One of the retaining means comprises an integral hook 14 extending from the inside of the arm 12 towards the other arm 11 and has a tip 15 which projects towards the base 11. The hook is sufficiently resilient to permit the tip 15 to be manually deflected away from the base 11 (shown in broken lines in FIG. 2) to permit a pin 30 of greater diameter than the distance between the tip and the base in the undeflected state of the hook to be inserted under the hook. The pin is retained between the hook and the base by releasing the hook and permitting it to assume its undeflected state.

More particularly, the construction comprises a first element 14 integral with the first arm and projecting substantially perpendicularly therefrom in the direction of the second arm 13 is a first element 14. The first element 14 terminates in a downwardly projecting second element 15. The second element 15 is substantially perpendicular to the first element 14 the free end 16 of which second element 15 is located a distance X units from the surface of the base 11. Also integral with the first element 14 is an L-shaped element 17 having a first leg 18 and a second leg 19. The first leg 18 projects upwardly from the first element 14 being substantially perpendicular thereto. The second leg 19 is integral with the first leg 18; substantially perpendicular thereto; and projects in the direction of the second arm 15.

The base 11, first arm 12, first element 14 and second element 15 generate a void into which may be inserted a first cylindrically shaped element 30. The distance X should be less than the diameter of the element 30 so as to enable the element 30 to be releasably retained in the void. It will be appreciated that the element 30 is rotatable in the void and may be removed by sliding in an axial direction. However, the use to which the device 10 will be concerned would not allow sufficient axial movement of the element 30 to enable it to be removed in the axial manner.

Figure 2:
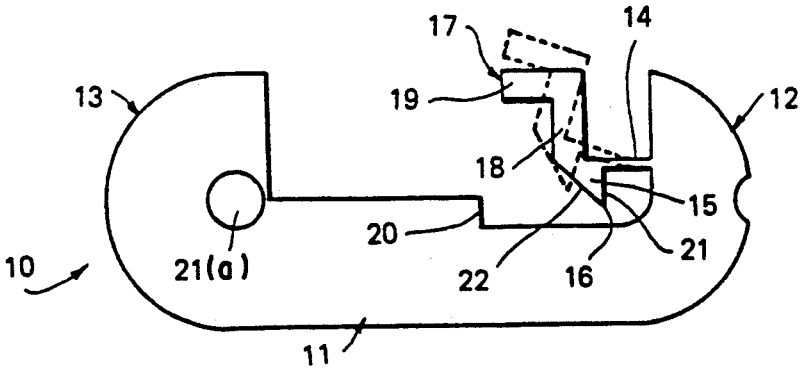
FIG. 2 is a cross-sectional view of the device of FIG. 1 of the drawings taken along the line II—II and viewed in the direction of the associated arrows.

To enable the element 30 to be easily removed from the void, the second leg 19 may be grasped and lifted upwardly causing the first element 14 to bend thereby increasing the distance between the free end 16 and the surface of the base 11 as shown in dotted outline in FIG. 2 of the drawings. Once released, the second leg 19 resumes its usual position to the resilient nature of the first element 14.

To assist in the insertion of the element 30 into the void, the surface of the base 11 has a step 20. In addition, the second element 15 is bounded by walls 21, 22. The wall 21 is substantially perpendicular to the surface of the base 11 being located on the proximal side of the element 15 i.e. the side nearest the first arm 11. The wall 22 is at an angle of about 45° relative to the surface of the base 11 being located on the distal side of the element 15. The walls 21, 22 meet in the free end or arris 16.

The second arm 13 may be constructed in a manner similar to the construction described with respect to the first arm 12. However, in the present embodiment it is only necessary for the arm 13 to have a through bore 21(*a*) which is substantially in parallel spaced apart relationship and coplanar relative to the void of the first arm 12. A second element 30 may be inserted into the bore 21(*a*).

The device 10 is preferably made from nylon using the technique of injection moulding.

In use, a plurality of devices 10 may be used to couple two or more barrier element.

Figure 3:
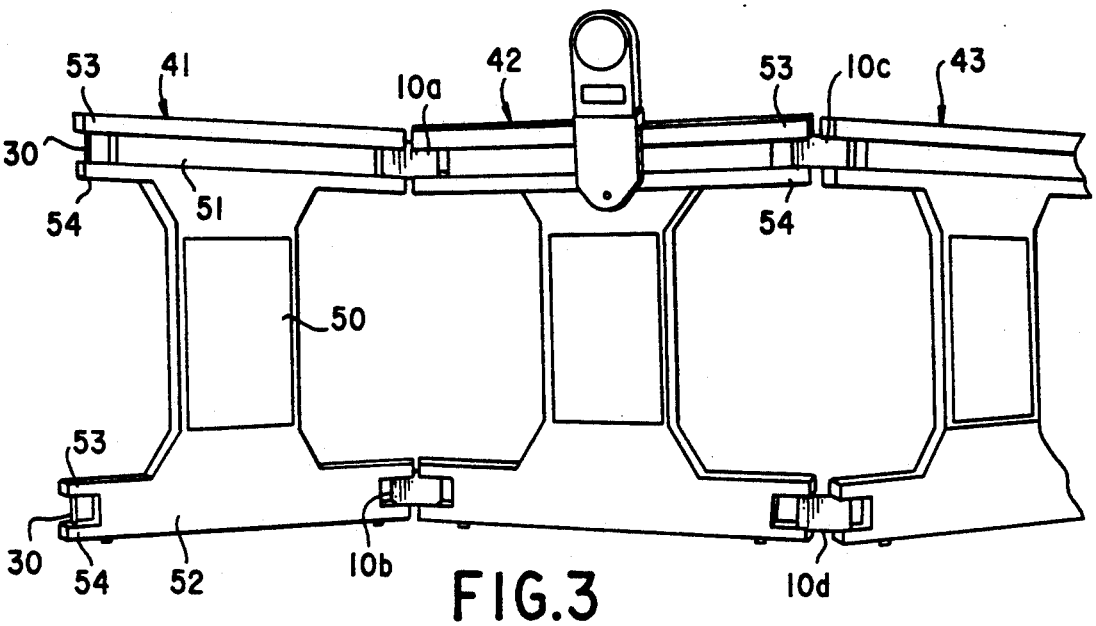
FIG. 3 is a perspective view of a plurality of devices of FIG. 1 of the drawings shown in use.
Figure 4:
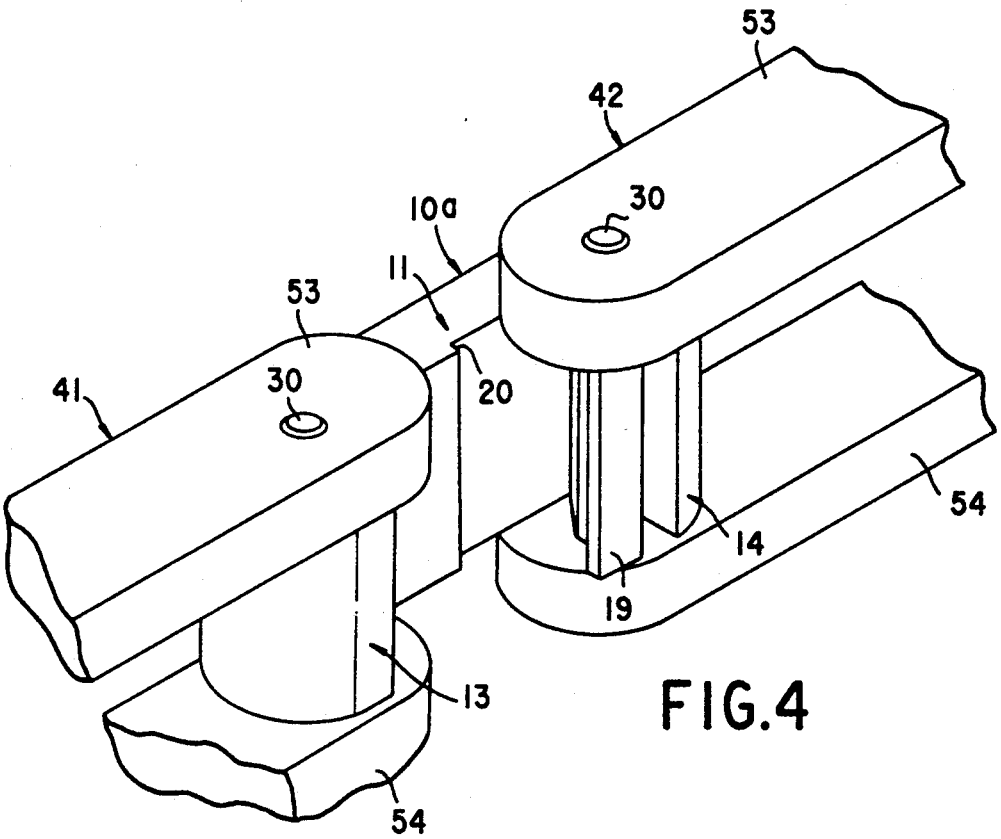
FIG. 4 is an enlarged detail taken from FIG. 3 of the drawings.

With particular reference to FIG. 3 of the drawings there is shown four devices according to the invention labelled 10*a*, 10*b*, 10*c* and 10*d* all of which are of the same construction as the device 10 described with respect to FIGS. 1 and 2 of the drawings. The four devices 10*a*–10*d* are used to interconnect three barrier elements 41, 42 and 43. Each barrier element 41–43 is the same construction and comprises I-shaped unit having a central support 50 and two cross-pieces 51, 52 integral therewith and in parallel spaced apart relationship. Each cross-piece 51, 52 terminates in a u-shaped element having legs 53, 54. Interconnecting the legs is the element 30, carried by it ends.

Each barrier element 41–43 has a pair of devices 10 attached thereto. Thus, for example, the barrier element 41 has the devices 10*a* and 10*b* attached thereto. Accordingly, the leg 13 of the device 10*a* is placed between the legs 53, 54 and the element 30 inserted so as to retain the leg 13 and hence the device 10*a* in captive relationship. To join the barrier element 42 to the barrier element 41, the element 30 of the barrier 41 is offered to the void of the device 10*a*, the leg 17 lifted so as to enable the element 30 to enter the void, the leg 17 is released.

A similar action takes place with respect to the device 10*b* and now the barriers 41 and 42 are interconnected and free to pivotally move relative to each other. The barrier 43 is connected to the barrier 42 in a similar fashion using the device 10*c* and 10*d*.

The barrier 41–43 may be released from each other by upward movement of the legs 17 thereby enabling the element 30 to be removed from the respective voids.

It will be appreciated that the devices 10*a*, 10*b* are held captive by the barrier 41; the devices 10*c* and 10*d* are held captive by the barrier 42. The devices 10 of the barrier 43 are not shown.

The invention is not limited by or to the specific embodiments described which can undergo considerable variation without departing from the scope of the invention.

I claim:

1. A coupling device comprising a generally u-shaped member having a base and two-arms, and retaining means proximate each arm for accommodating and retaining a respective cylindrical pin rotatable about its own axis, at least one of the retaining means comprising an integral hook extending from the inside of the respective arm towards the other arm and having a tip which projects towards the base, the hook being sufficiently resilient to permit the tip to be manually deflected away from the base to permit a pin of greater diameter than the distance between the tip and the base in the undeflected state of the hook to be inserted under the hook, the pin being retained between the hook and the base by releasing the hook and permitting it to assume its undeflected state.

2. A coupling device as claimed in claim 1, wherein the other retaining means also comprises a hook constructed as aforesaid.

3. A coupling device as claimed in claim 1, wherein the other retaining means comprises a bore through the member.

4. A coupling device as claimed in claim 1 wherein the hook includes a leg extending therefrom away from the base to permit manual deflection of the hook by manipulation of the leg.

5. An assembly of at least two elements coupled together by a device as claimed in claim 1 wherein each element carries a respective cylindrical pin by its ends and the middle part of each pin is accommodated and retained in a respective retaining means of the coupling device.

6. An assembly of at least two elements coupled together by a device as claimed in claim 2, wherein each element carries a respective cylindrical pin by its ends and the middle part of each pin is accommodated and retained in a respective retaining means of the coupling device.

7. An assembly of at least two elements coupled together by a device as claimed in claim 3, wherein each element carries a respective cylindrical pin by its ends and the middle part of each pin is accommodated and retained in a respective retaining means of the coupling device.

8. An assembly of at least two elements coupled together by a device as claimed in claim 3, wherein each element carries a respective cylindrical pin by its ends and the middle part of each pin is accommodated and retained in a respective retaining means of the coupling device.

* * * * *